US006349519B1

(12) United States Patent
Beller

(10) Patent No.: US 6,349,519 B1
(45) Date of Patent: Feb. 26, 2002

(54) APPARATUS FOR SECURING SHEETING

(76) Inventor: Brad F. Beller, 400 Harvest Gate, Lake in the Hills, IL (US) 60102

( * ) Notice: Subject to any disclaimer, the term of this patent is extended or adjusted under 35 U.S.C. 154(b) by 0 days.

(21) Appl. No.: 09/451,174

(22) Filed: Nov. 30, 1999

(51) Int. Cl.[7] ..... E04B 2/00

(52) U.S. Cl. ..... 52/410; 52/411; 52/417; 52/506.01

(58) Field of Search ..... 52/553, 554, 558, 52/559, 506.01, 410, 411, 417

(56) References Cited

U.S. PATENT DOCUMENTS

| | | | | | |
|---|---|---|---|---|---|
| 1,263,219 | A | * | 4/1918 | Fischer | 52/549 |
| 1,927,436 | A | * | 9/1933 | Fischer | 52/529 |
| 2,109,673 | A | * | 3/1938 | McGee | 52/478 |
| 4,288,951 | A | * | 9/1981 | Carlson et al. | 52/94 |
| 4,382,353 | A | * | 5/1983 | Kelly | 52/305.5 X |
| 4,445,306 | A | | 5/1984 | Schauffele | |
| 4,525,967 | A | | 7/1985 | Simpson | |
| 4,653,246 | A | | 3/1987 | Hepler | |
| 4,885,887 | A | * | 12/1989 | Simmons et al. | 52/410 |
| 4,963,430 | A | | 10/1990 | Kish et al. | |
| 5,242,736 | A | | 9/1993 | Van Erden et al. | |
| 5,469,671 | A | * | 11/1995 | Rathgeber et al. | 52/58 |
| 5,488,807 | A | * | 2/1996 | Terrenzio et al. | 52/555 |
| 5,497,596 | A | | 3/1996 | Zatkulak | |
| 5,577,361 | A | * | 11/1996 | Grabek, Jr. | 52/543 |
| 5,922,432 | A | | 7/1999 | Kalal | |
| 5,937,603 | A | * | 8/1999 | Zeidler | 52/408 |

* cited by examiner

*Primary Examiner*—Beth A. Stephan
*Assistant Examiner*—Brian E. Glessner
(74) *Attorney, Agent, or Firm*—Olson & Hierl, Ltd.

(57) ABSTRACT

A batten for securing sheeting to a substrate is comprised of a lengthwise strip having fastening surfaces thereon. The fastening surfaces are spacially related along the length of the strip to coincide with the spacial relationship present between structural members of a standard wall structure. The fastening surfaces thus serve as indicators of the locations of such structural members. Each fastening surface includes a moisture barrier that forms a moisture-tight seal around a fastener when driven through the fastening surface and sheeting and into the substrate.

14 Claims, 5 Drawing Sheets

APPARATUS FOR SECURING SHEETING

TECHNICAL FIELD OF THE INVENTION

The present invention generally relates to an apparatus for securing sheeting to a wall surface and, in particular, for indicating preferred locations of attachment of sheeting to the wall surface so that the tearing of the sheeting from the wall surface and the penetration of moisture through the sheeting at the locations of attachment is reduced.

BACKGROUND OF THE INVENTION

During the construction of a building, plastic sheeting or a similar membrane is secured to an exterior wall surface (i.e., the wall substrate or underlayment) prior to the application of a final exterior wall covering, such as aluminum, wood or vinyl siding. This plastic sheeting resists moisture that may penetrate through gaps existing in the exterior wall covering, thereby protecting the underlying wall structure from moisture damage.

Several approaches for securing plastic sheeting to a wall structure have been proposed in the past. One common method for securing plastic sheeting to a wall structure includes the use of staples. A use of staples simply involves driving a staple through the plastic sheeting into the underlying structure.

However, several disadvantages exist when using staples to secure plastic sheeting to a wall structure. Moisture can easily migrate through the holes in the sheeting created by the staples, thus causing damage to the underlying wall structure. Also, because the surface area of a staple is minimal, the staple provides little resistance to tearing of the plastic sheeting from the wall structure. Furthermore, using staples, as opposed to other fasteners, will result in a minimum of 50% more punctures in the sheeting due to the fact that each staple has two shanks.

Another common method for securing plastic sheeting to a wall structure includes the use of nails driven through plastic washers placed between the sheeting and the head of the nail. The plastic washer increases the surface area of the nail head at the point of attachment, thereby providing an increased resistance to tearing of the plastic sheeting from the wall structure.

However, like staples, several disadvantages exist when using nails, with or without washers, to secure plastic sheeting to a wall structure. Holes created in the plastic sheeting (where the nail is driven into the wall) may allow moisture to penetrate the sheeting and damage the underlying structure. Furthermore, the placement of a washer below a nail before driving the nail into the wall structure, particularly on a repetitive basis in a construction setting, can be cumbersome and time consuming.

A third method for securing plastic sheeting to a wall structure includes the use of battens. Battens, typically comprised of metal, wooden or plastic strips, are placed over the exterior surface of a wall structure with the plastic sheet located between the wall underlayment and the batten. Mechanical fasteners, such as screws, nails or staples, are driven through the batten and into the wall structure. The battens may be pre-punched to accommodate placement of the fasteners.

Several disadvantages exist when using battens to secure plastic sheeting to a wall structure. Holes created in the sheeting by the fasteners, driven through the batten, may allow moisture to penetrate the sheeting and damage the underlying structure. Also, a typical batten does not indicate the most desirable location to drive a given nail into the wall.

When driving nails through a batten to secure plastic sheeting, it is desirable to drive the nails into an area of the wall where the underlayment is directly supported by a stud or other supporting member. Although a typical wall has a stud vertically placed every 16 inches on center along its length, the stud is nonetheless difficult to locate when driving nails because it is covered by the underlayment of the wall structure.

Thus, there is a need for an apparatus that indicates preferred locations of attachment to a wall structure and reduces both the tearing of the sheeting from the wall surface and the penetration of moisture through such sheeting at locations of attachment.

SUMMARY OF THE INVENTION

The present invention provides a novel and improved batten which reduces the foregoing disadvantages associated with the prior art and provides advantages in construction, mode of operation and use.

To achieve the foregoing, in one form of the invention, the batten comprises a plastic strip (or similar material); for example, about 1/16 inch thick and 3/4 inch wide. The strip has an extended "fastening surface" placed at multiples of a preselected distance (for example, about 16 inches on center) along its length. The center of the fastening surface may be pre-punched with a hole to accommodate a nail or similar fastener driven therethrough.

The fastening surfaces, located along the length of the strip at multiples of the preselected distance, indicate the desired location for driving a fastener. Although the batten can be applied to a wall structure vertically, one applying the batten horizontally can thus locate underlying studs and drive the fastener through the sheeting and underlayment and into the stud, assuming the studs are positioned in accordance with preselected distance.

The extended "fastening surfaces" of the batten also provide an increased surface area between the fastener and the sheeting at the points of attachment. Such increased surface areas thus prevent a tearing of the sheeting from the wall where the fasteners are driven into the wall structure.

In addition, the underside of each extended fastening surface can include a compressible moisture barrier attached thereto such that, when the batten is placed over the plastic sheeting, the moisture barrier lies between the batten and sheeting. The moisture barrier is preferably not pre-punched to accommodate the insertion of a fastener therethrough.

In operation, the fastener is driven through the batten and moisture barrier, resulting in a resistance-fit between the moisture barrier and fastener. When the fastener is seated against the batten, the moisture barrier is compressed between the extended fastening surface and sheet, creating a moisture-tight fit at the point of attachment of the batten to the wall structure.

BRIEF DESCRIPTION OF THE DRAWINGS

In the drawings,

FIG. 4 illustrates a batten mounted horizontally to the wall structure, it is contemplated that the batten can be mounted vertically as well.

DESCRIPTION OF THE PREFERRED EMBODIMENT

Figure 1:
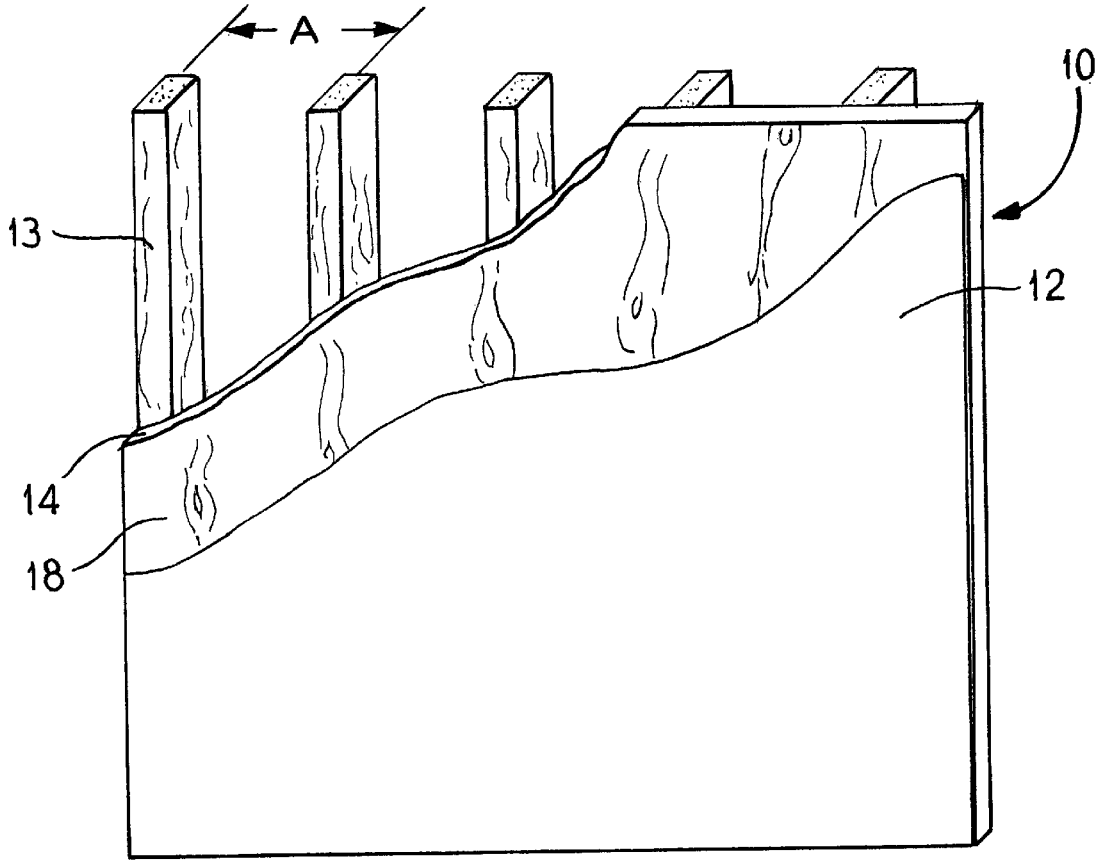
FIG. 1 is a perspective elevational view of a flat wall structure on which a sheeting is positioned.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Referring to FIG. 1, a flat wall structure 10 is shown upon which a sheeting 12 is located. The wall structure 10 may be comprised of an underlayment 14 supported by a plurality of structural members 13 spaced apart a preselected distance A (for example, about 16 inches on center). The underlayment 14 may take any suitable form, such as a metal or wood panels or the like. The structural members 13 comprise vertically extending columns or studs. The structural members 13 may be comprised of metal, wood, or other material capable of providing adequate structural support to the underlayment 14.

The sheeting 12, typically comprised of a water-impervious material, can also take a variety of forms. The sheeting 12 may be comprised of plastic, rubber, tar-paper, polystyrene or other similar material. The sheeting 12 is placed on top of the exterior surface 18 of the underlayment 14 by the positioning of unrolled sections from a suitable roll or the positioning of individual sheets or panels from a suitable stack. The sheeting 12 is properly positioned on top of the underlayment 14 with the edges thereof overlapping that of adjacent sheeting.

Figure 2:
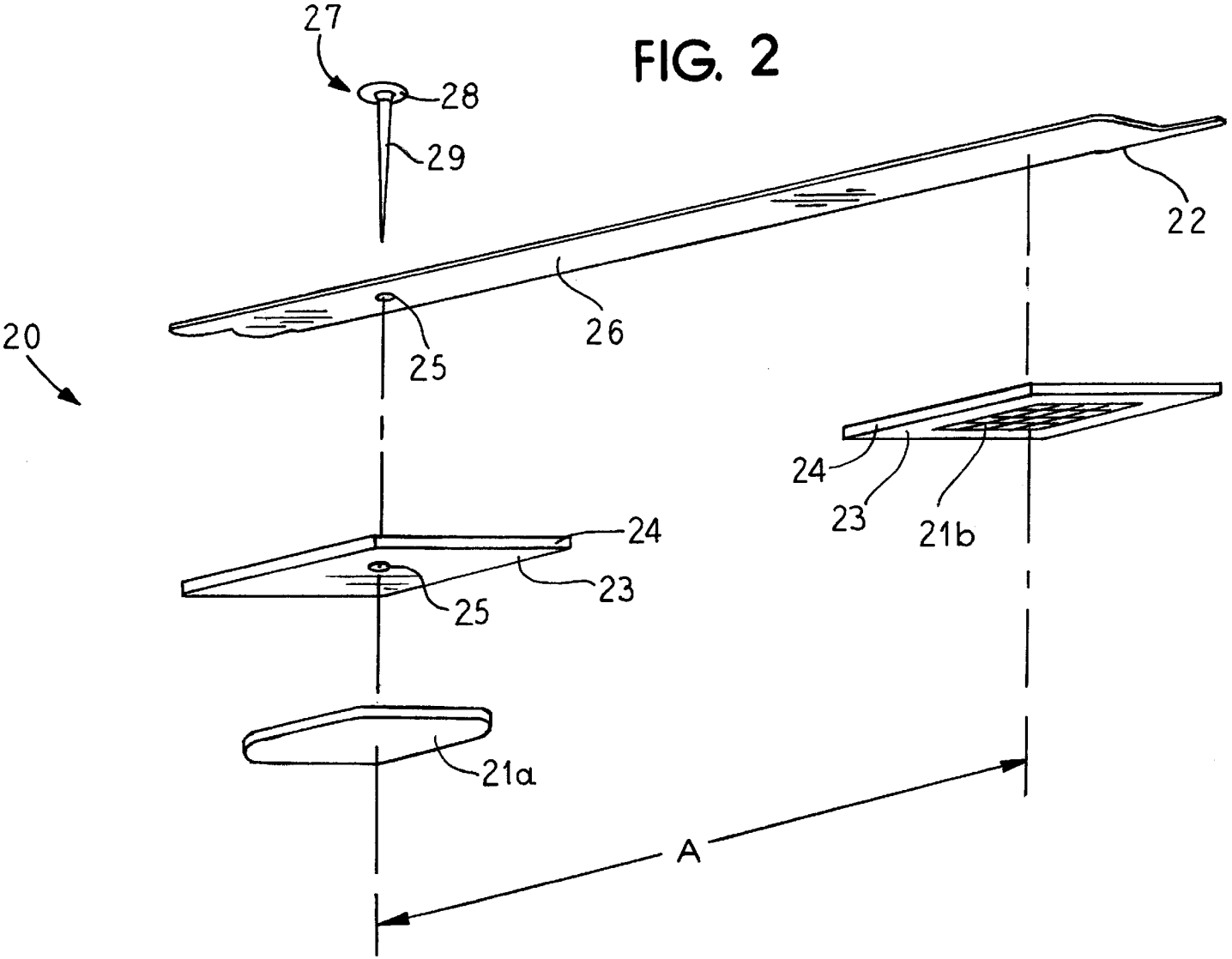
FIG. 2 is an exploded perspective view of the batten in accordance with one embodiment of the invention.

To secure the sheeting 12 to the wall structure 10, the securing apparatus of the present invention is utilized. One embodiment of the invention, illustrated in FIG. 2, shows a securing apparatus 20 which includes an elongated strip 22 of resilient material comprising paper, plastic or other similar material. Upon further inspection of FIG. 2, it will be seen that the strip 22 includes a plurality of fastening surfaces 24 (only two are illustrated for clarity) contiguous with the strip 22 and located on the lower surface 26 of the strip in a spaced relationship along the length of the strip.

The fastening surfaces 24 should preferably be made of a water-impervious material such as plastic or the like. The extended fastening surfaces are attached to the lower surface 26 of the strip 22 at the appropriate locations, as discussed below. Attachment of the extended fastening surfaces 24 to the strip 22 can occur through any number of methods including, but not limited to gluing, sewing, stamping, or bonding of the plastic fastening surfaces to the strip through heat application methods.

Figure 3:
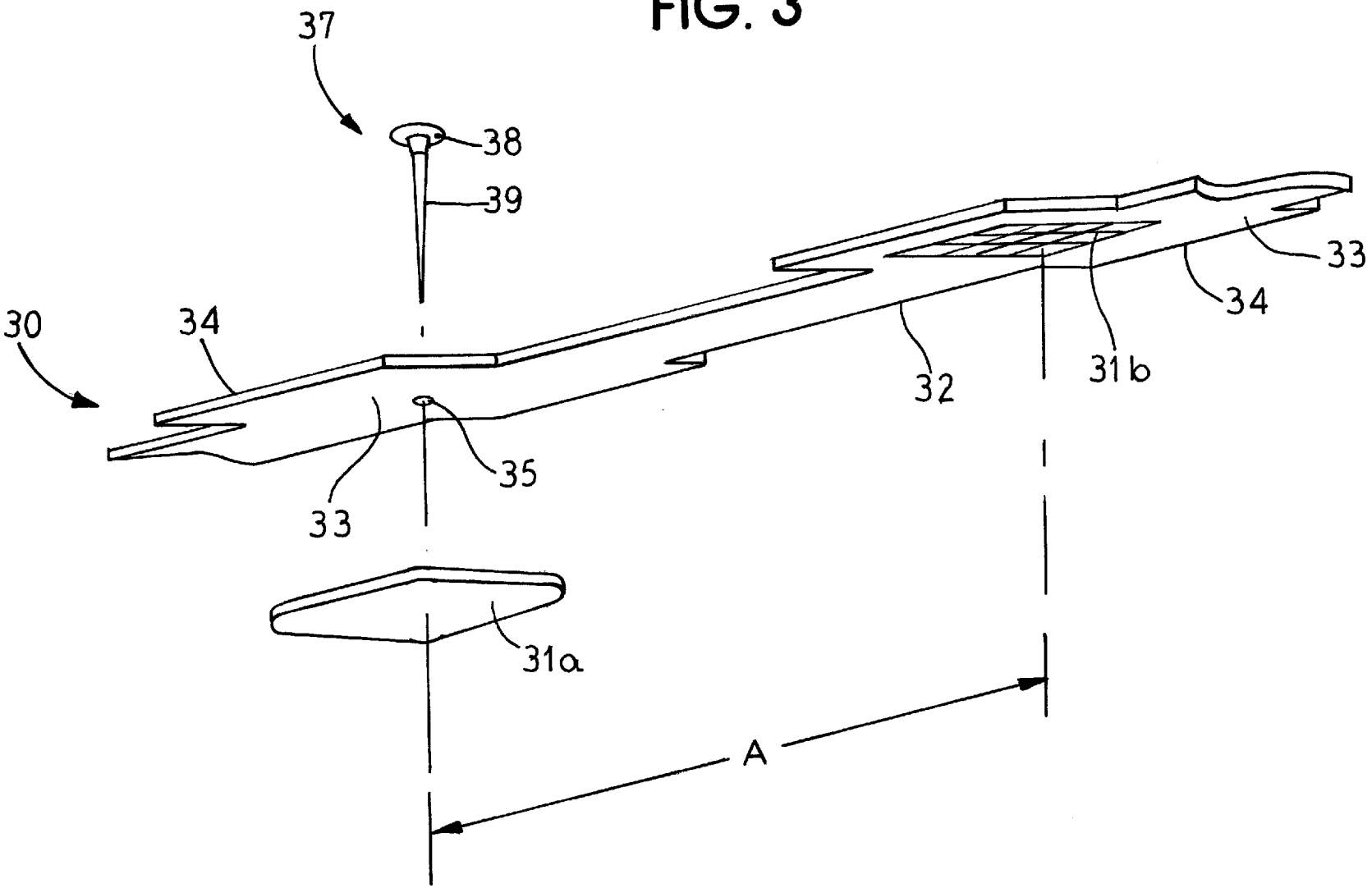
FIG. 3 is an exploded perspective view of the batten in accordance with another embodiment of the invention.

As illustrated in FIG. 3, an additional embodiment of the securing apparatus or batten 30 includes both the strip 32 and extended fastening surfaces 34 comprised of a conventional water-impervious material (i.e. plastic), with the material of the extended fastening surfaces 34 being integral with the strip 32. The batten 30, having the strip 32 with extended fastening surfaces 34 integral therein, may be stamped from a common sheet of plastic material. The batten 30 may also be created through a molding process or the like.

As illustrated in FIGS. 2 and 3, the fastening surfaces 24 and 34, respectively, each have a surface dimension that exceeds the width of the respective strips 22 and 32. This extended surface dimension provides an increased surface area between a given fastener and the sheeting at the points of attachment. Such increased surface areas thus resist a tearing of the sheeting from the surface of the underlayment where fasteners are driven through the batten and into the wall structure.

To form the extended surface area requisite of a fastening surface, the fastening surface can have any shape, so long as the dimension of the fastening surface extends beyond the width of the strip. For example, although the battens 20 and 30 illustrated in FIGS. 2 and 3, respectively, show fastening surfaces 24 and 34 having a square shape, the fastening surfaces 24 and 34 can have a circular, hexagonal, octagonal, triangular, or other shape. In addition, although FIGS. 2 and 3 each illustrate a batten having fastening surfaces comprised of the same shape, each batten can also have fastening surfaces comprised of a combination of two or more different shapes.

Furthermore, battens 20 and 30 as illustrated in FIGS. 2 and 3, respectively, may include pre-formed holes 25 and 35, respectively, provided therein to accommodate the driving of fasteners 27 and 37 therethrough. Such holes coincide with the center of fastening surfaces 24 and 34, respectively, and are dimensioned to permit the shanks 29 and 39 of the fastener, but not to the fastener heads 28 and 38, to pass through the respective batten.

Attention is again drawn to FIGS. 2 and 3, illustrating that the fastening surfaces 24 and 34 are located along the length of the respective strips 20 and 30 at preselected distances A. This distance coincides with the spacial relationship of the structural members 13, illustrated in FIG. 1, that support the underlayment 14 of wall structure 10. It is noted, however, that although FIGS. 2 and 3 illustrate a preselected distance A, the interval can be any multiple thereof (i.e., 2A, 3A, etc.).

The interval between fastening surfaces is typically a multiple of 16 inches because various building standards within the United States require that the structural members of a given wall structure be vertically located along the length of a wall structure at a center-to-center distance from each other of 16 inches. Wall structures in compliance with such standards, as illustrated in FIG. 1, typically have a series of structural members vertically located every 16 inches along the length of the wall, with the first structural member of the series usually being located at a starting edge of the wall.

Because the structural members provide structural support to the underlayment of a wall structure, it is desirable when securing plastic to the exterior surface of such underlayment to drive the fasteners into locations of the underlayment that are directly supported by structural members. However, one applying sheeting to the exterior surface of a wall structure usually cannot see the locations of the structural members because the structural members lie behind the underlayment, out of the applicator's view.

Figure 3A:
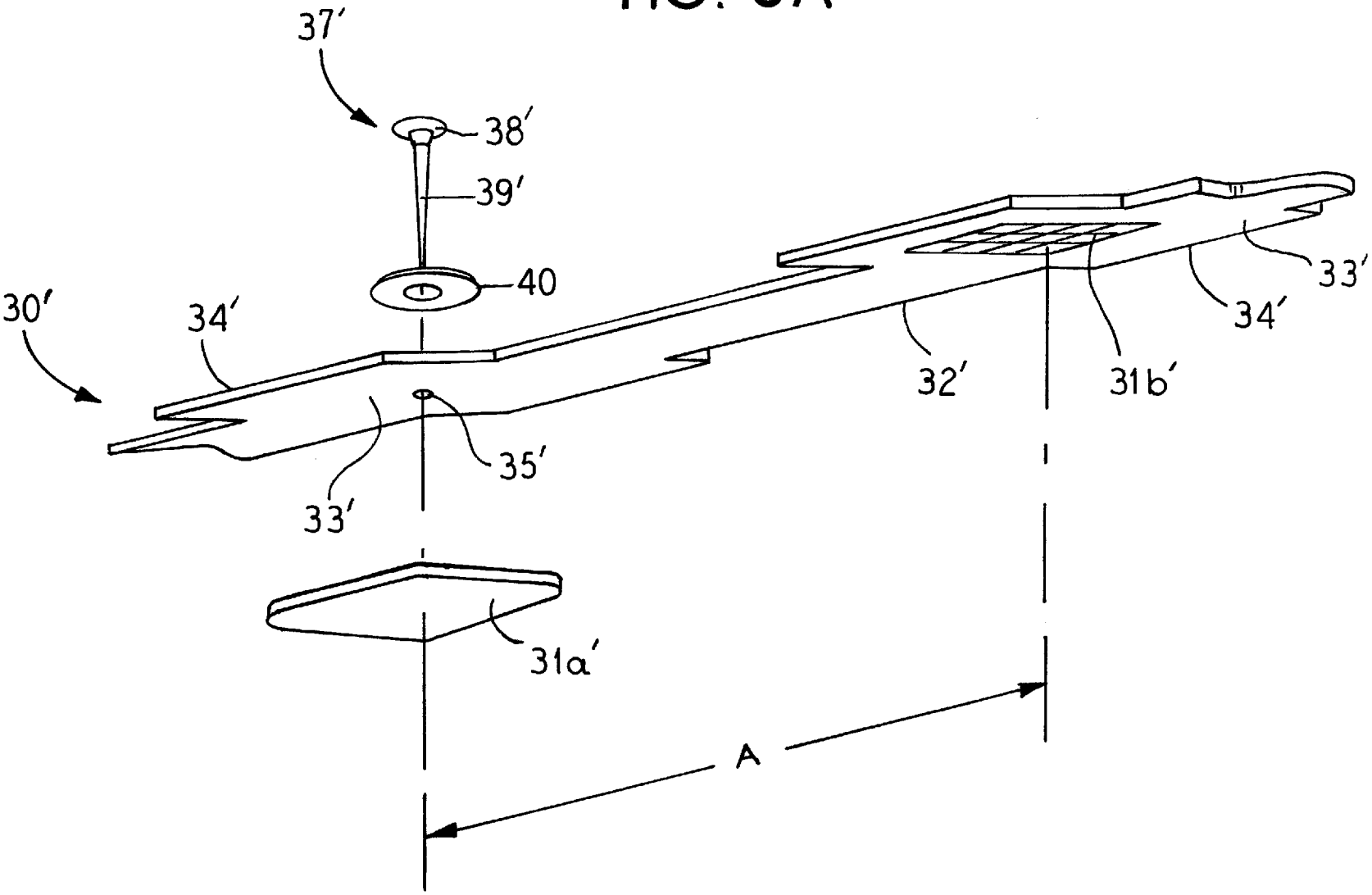
FIG. 3A is a view similar to FIG. 3, but showing an alternative embodiment of the batten.

FIG. 3A illustrates an alternative embodiment 30' of the inventive batten. Embodiment 30' is similar to embodiment 30 and similar parts are correspondingly numbered but with the addition of prime marks thereto for convenient identification purposes. In embodiment 30', a grommet 40 is located at each extended edge surface region of the batten 30' so that the shank 39' of the fastener can pass therethrough but retain the head 38' thereof, thus reinforcing the structure of batten 30' under use conditions. Preferably, the grommet 40 is comprised of resilient material which also aids in contributing resistance to moisture penetration.

Thus, in keeping with one of the principal advantages of the invention, the fastening surfaces function as indicators of the desired locations along the strip through which to drive a fastener into the wall structure when securing sheeting. Because the fastening surfaces are located, for example, at multiples of 16 inches along the length of the strip, one applying the batten horizontally can locate each underlying structural member of a given series, positioned every 16 inches on center along the length of the wall.

Figure 4:
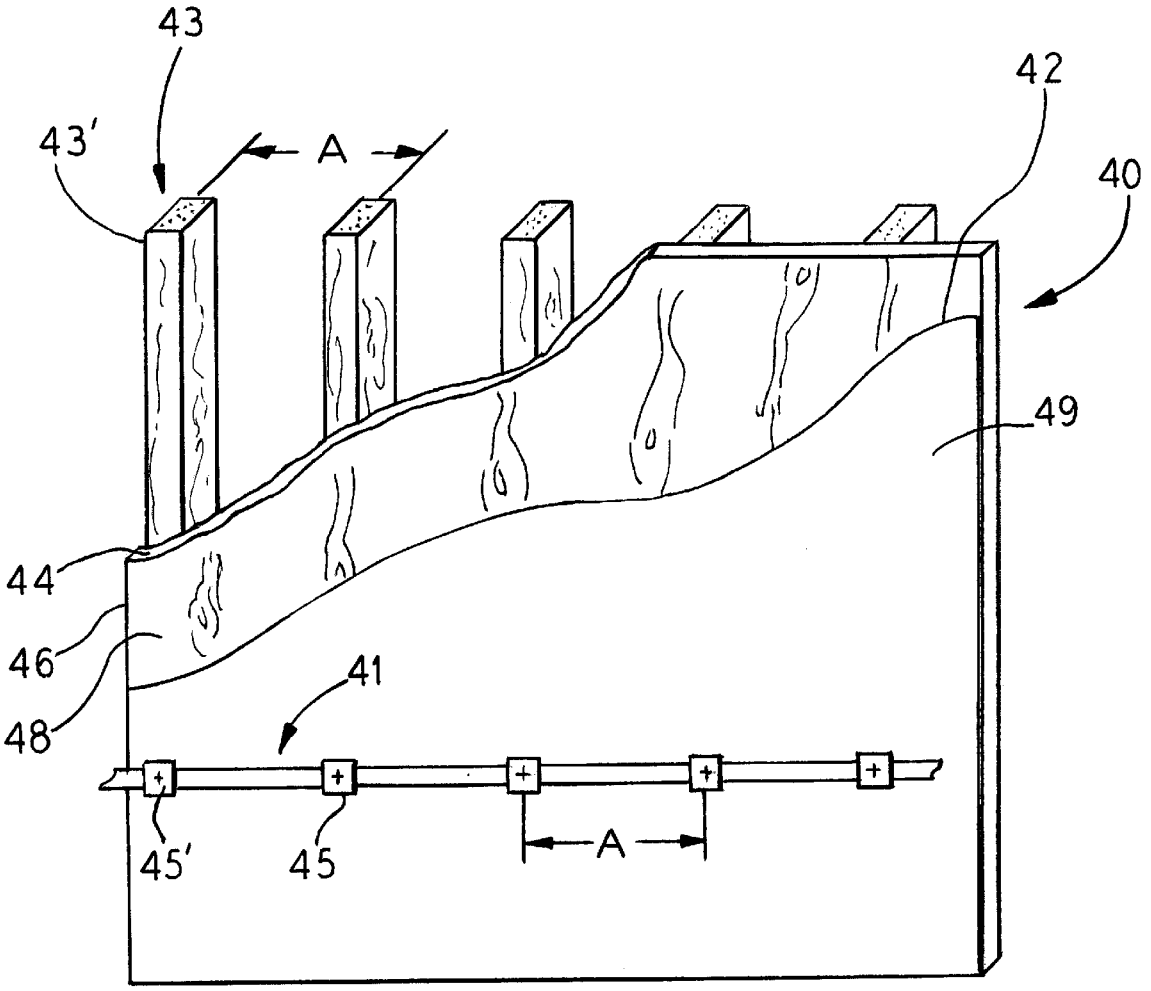
FIG. 4 is a perspective elevational view of a flat wall structure on which a sheeting is positioned and mechanically attached to the underlying wall structure with the securing apparatus of the present invention. Although

FIG. 4 illustrates how the fastening surfaces of a batten indicate the position of the structural members of a wall structure and thus the desired location through which to drive a fastener. Wall structure 40 is comprised of a series of structural members 43, vertically located from each other by a preselected distance A. Attached to the structural members is underlayment 44, with sheeting 42 located on the outer surface 48 of the underlayment. Outer edge 46 of underlayment 44 is located on the first structural member 43' of the series of structural members 43.

As shown in FIG. 4, batten 41 is horizontally located across the outer surface 49 of the sheeting 42. In accordance with the teachings of this invention, batten 41 has fastening surfaces 45 located from each other by the preselected distance A. By placing a first fastening surface 45', one of the extended fastening surfaces 45, over the center of first structural member 43', one can locate the remaining structural members of series 43 within the wall structure 40 by identifying the location of the remaining fastening surfaces 45 of the batten 41. As a result, when one drives a fastener (not shown) through the batten 41 and into the wall structure 40, the fastener will enter the underlayment in a location directly supported by a structural member of the series 43 (the desired location for attaching the batten 41 to the wall structure 40).

Although FIG. 4 illustrates a batten mounted horizontally to the wall structure 40, one can also mount the batten 41 vertically, driving all fasteners into a common structural member of the series 43.

The present invention is also concerned with preventing moisture from penetrating through the sheeting at attachment locations of the batten to the wall. Moisture penetration is possible at attachment locations due to the fact that fasteners penetrate the sheeting when driven through the batten and into the wall structure. Moisture, if allowed to penetrate the sheeting, can cause damage to the underlying wall structure. To prevent such moisture penetration from occurring, provision is made in the present invention for a moisture barrier at each fastening surface.

Referring again to FIGS. 2 and 3, in one embodiment of the invention, the moisture barrier may comprise gaskets 21*a* and 31*a*, respectively, located adjacent to the lower surfaces 23 and 33 of fastening surfaces 24 and 34, all lying on a common side of the battens 20 and 30. The gaskets 21*a* and 31*a* may be fabricated of a compressible, water-proof rubber material. The gaskets 21*a* and 31*a* are sandwiched between, and in intimate contact with, both the lower surfaces 23 and 33 of the fastening surfaces 24 and 34 and the upper surface of the sheeting (not shown) underlying the battens 20 and 30, respectively.

In another embodiment, again illustrated in FIGS. 2 and 3, the moisture barrier may comprise a water-impervious foam coating, 21*b* and 31*b*, applied to the lower surfaces 23 and 33 of the fastening surfaces 24 and 34, respectively. The foam coating composition and application may be formed by any known mechanical or chemical foaming process. For purposes of the invention, a coating thickness of between about 0.045 to about 0.055 inches is preferred. The foam is applied to the fastening surfaces of the batten and may be "wet" or dry when the batten is placed upon the sheeting.

Both the foam and gasket embodiments of the moisture barrier may have adhesion properties which allow the gasket or foam to adhere to both the fastening surfaces of the batten and the sheeting of the wall structure.

In operation, after the sheeting has been laid across the outer surface of the wall structure underlayment, the battens, with their fastening surfaces and associated moisture barriers, are horizontally placed on top of the sheeting at the desired locations with the moisture barriers between the sheeting and the fastening surfaces of the batten.

Once the battens are placed in their desired locations on the wall structure surface, the fasteners are then driven down through the extended fastening surfaces, through the associated moisture barriers, through the underlying sheeting, and finally into the wall structure therebelow. Since the moisture barriers, positioned between the sheeting and the fastening surfaces of the batten, do not include pre-formed holes to receive the fasteners driven therethrough, the openings created in the moisture barrier by the fastener will tightly embrace the shank of the fastener.

Thus, when the head of the fastener is seated against the exterior surface of the fastening surface, the moisture barrier is compressed between the lower surface of the fastening surface and exterior surface of the sheeting and around the shank of the fastener to create a water-tight compression seal around the fastener at the fastening site.

The foregoing description and the accompanying drawings are illustrative of the present invention. Still other variations and arrangements of parts are possible without departing from the spirit-and scope of this invention.

What is claimed is:

1. A batten assembly adapted for the mounting of sheeting to generally flattened surface portions of a wall structure, said batten assembly comprising in combination:

(a) an elongated, relatively narrow, relatively thin strip having generally opposed, generally longitudinally extending, lateral edge portions and also transversely spaced, opposed, generally parallel, respective outside and inside faces, (b) a plurality of discrete regions, each said region having a location that is at a preselected distance along said strip and that is longitudinally spaced from each adjacent said region, each said region having opposite lateral outside edge portions that are located outwardly beyond said lateral edge portions, (c) a moisture barrier means associated with each said location, and (d) the association between said strip, said regions, and said moisture barrier means being such that a pointed fastener means can be extended at each said location transversely through each of said strip, one said region, and said moisture barrier means, whereby, when said fastener means is so extended through each one of a plurality of said locations along said strip and is driven into said generally flattened surface portions with said sheeting being located between said batten assembly and said generally flattened surface portions, said batten assembly and said fastener means coact to retain said sheeting upon said generally flattened surface portions with said fastener means being in a substantially moisture-tight association with said batten assembly and said sheeting and without tearing of said sheeting.

2. The batten assembly of claim 1 wherein said preselected distance is substantially equal between adjacent said locations and wherein said preselected distance is adapted to generally correspond to the spacing between individual structural members of a structural member plurality that support and attach to wall defining means which provides said generally flattened surface portions.

3. The batten assembly of claim 2 wherein said structural members at said wall structure extend generally vertically, wherein said batten assembly is adapted to extend generally horizontally over said generally flattened surface portions so that each one of said locations generally overlies a different one of said structural members, and wherein one elongated said fastener means is extend through substantially each one of said plurality of locations along said strip and also is to be driven into said generally flattened surface portions and into each one of said structural members at each one of said locations with said sheeting being located between said batten assembly and said generally flattened surface portions, so that said batten assembly is adopted to coast with said structural members to retain said sheeting upon said generally flattened surface portions with said fastener means being in a substantially moisture-tight association with said batten assembly and said generally flattened surface portions and without tearing of said sheeting.

4. The batten assembly of claim 1 wherein said strip is comprised of plastic.

5. The batten assembly of claim 1 wherein, at each said region, a separately formed generally flattened member is provided which is attached on one surface portion thereof to said strip.

6. The batten assembly of claim 5 wherein said flattened member is located adjacent to a portion of said inside face.

7. The batten assembly of claim 6 wherein said flattened member is comprised of plastic.

8. The batten assembly of claim 1 wherein, at each said region, said lateral edge portions are broadened in the vicinity of said location and said region is integral with said strip.

9. The batten assembly of claim 1 wherein said moisture barrier means is located in said batten assembly so as to be adjacent to said sheeting when said batten assembly is located against said sheeting.

10. The batten assembly of claim 9 wherein said moisture barrier means comprises a coating.

11. The batten assembly of claim 9 wherein said moisture barrier means comprises a compressible gasket.

12. The batten assembly of claim 11 wherein said compressible gasket comprises a rubber material.

13. The batten assembly of claim 1 wherein in a mid-region of each said location an aperture is defined in said strip.

14. The batten assembly of claim 1 wherein each said region is additionally provided with a grommet that is adapted for receipt therethrough of said fastener means.

* * * * *